United States Patent [19]

Yagi et al.

[11] Patent Number: 5,074,260

[45] Date of Patent: Dec. 24, 1991

[54] VALVE DRIVING DEVICE AND VALVE DRIVING METHOD FOR INTERNAL COMBUSTION ENGINE

[75] Inventors: Shizuo Yagi; Youichi Ishibashi; Hiroshi Sono, all of Saitama, Japan

[73] Assignee: Honda Giken Kogyo Kabushiki Kaisha, Tokyo, Japan

[21] Appl. No.: 515,438

[22] Filed: Apr. 27, 1990

[30] Foreign Application Priority Data

Apr. 27, 1989 [JP] Japan ..... 1-108946

[51] Int. Cl.[5] ..... F01L 1/34

[52] U.S. Cl. ..... 123/90.16; 123/90.17; 123/90.31

[58] Field of Search ..... 123/90.15, 90.16, 90.17, 123/90.27, 90.31, 316

[56] References Cited

U.S. PATENT DOCUMENTS

| | | | |
|---|---|---|---|
| 3,714,932 | 2/1973 | Meacham et al. | 123/316 |
| 3,953,969 | 5/1976 | Mori et al. | 123/316 |
| 4,192,265 | 3/1980 | Amano et al. | 123/316 |
| 4,221,197 | 9/1980 | Kuroda et al. | 123/316 |
| 4,438,735 | 3/1984 | Burandt | 123/90.16 |
| 4,494,506 | 1/1985 | Hayama et al. | 123/90.18 |
| 4,539,951 | 9/1985 | Hara et al. | 123/90.17 |
| 4,552,112 | 11/1985 | Nagao et al. | 123/90.17 |
| 4,582,029 | 4/1986 | Masuda et al. | 123/90.16 |
| 4,592,310 | 6/1986 | Hitomi et al. | 123/90.17 |
| 4,708,101 | 11/1987 | Hara et al. | 123/90.17 |
| 4,854,272 | 8/1989 | Konno | 123/90.17 |
| 4,876,995 | 10/1989 | Otobe et al. | 123/90.16 |
| 4,878,462 | 11/1989 | Kurisu et al. | 123/90.17 |
| 4,964,375 | 10/1990 | Takeyama et al. | 123/90.16 |

FOREIGN PATENT DOCUMENTS

| | | | |
|---|---|---|---|
| 44-23442 | 10/1969 | Japan . | |
| 55-91714 | 7/1980 | Japan . | |
| 56-104130 | 8/1981 | Japan . | |
| 57-188714 | 11/1982 | Japan . | |
| 57-188715 | 11/1982 | Japan . | |
| 57-188716 | 11/1982 | Japan . | |
| 57-188718 | 11/1982 | Japan . | |
| 59-5707 | 1/1984 | Japan . | |
| 0046307 | 3/1984 | Japan | 123/90.16 |
| 59-231115 | 12/1984 | Japan . | |
| 0081413 | 5/1985 | Japan | 123/90.15 |
| 0150409 | 8/1985 | Japan | 123/90.15 |
| 61-96112 | 5/1986 | Japan . | |
| 61-24533 | 6/1986 | Japan . | |
| 61-56408 | 12/1986 | Japan . | |
| 63-47607 | 12/1988 | Japan . | |
| 64-6323 | 2/1989 | Japan . | |

*Primary Examiner*—Willis R. Wolfe
*Assistant Examiner*—Weilun Lo
*Attorney, Agent, or Firm*—Lyon & Lyon

[57] ABSTRACT

A valve train for a four-cycle, double overhead camshaft type internal combustion engine includes apparatus for movably supporting the camshafts that mount the cams which operate the intake and exhaust valves respectively so that the camshafts and cams are displaceable with respect to the rocker arms through which the operation of the cams is imparted to the valves. A control system is described that enables the camshaft supporting apparatus to be selectively displaced in response to engine operating conditions, such as rotational speed, so that valve timing and valve lift for the respective valves can be independently varied to produce optimal engine operating characteristics over a wide range of engine operating conditions. A method of operating engine valves in accordance with utilization of the described control system is also disclosed.

14 Claims, 7 Drawing Sheets

VALVE DRIVING DEVICE AND VALVE DRIVING METHOD FOR INTERNAL COMBUSTION ENGINE

BACKGROUND OF THE INVENTION

The present invention relates to a valve train for a 4-cycle internal combustion engine of a so-called, "double overhead camshaft" or (DOHC) type, and, more particularly, to a valve driving device and a valve driving method for such internal combustion engine which can adjust the valve timing and the valve lift of an intake valve and an exhaust valve individually.

It is known that the valve timing and valve lift of an intake valve and an exhaust valve in a 4-cycle internal combustion engine have a large influence upon the performance of the engine. However, the optimum valve timing and the optimum valve lift will vary with a change in rotational speed of the engine. Therefore, if in the design of an engine an optimum valve timing and an optimum valve lift are selected for a certain rotational speed region, there occurs the problem that ideal performance cannot be obtained in the other rotational speed regions of the engine. To cope with this problem, there has been proposed, as described in Japanese Utility Model Publication No. 44-23442, a valve train capable of adjusting the valve timing and the valve lift of the intake valve and the exhaust valve according to a change in rotational speed of the internal combustion engine.

The valve train described in Japanese Utility Model Publication No. 44-23442 includes a camshaft having a cam contacting a rocker arm, a cam gear meshing an idler gear, and a camshaft supporting arm having one end pivotably supported with respect to a rotating shaft of the idler gear and the other end at which the camshaft is rotatably supported. The camshaft supporting arm is angularly displaceable about the rotating shaft of the idler gear according to a change in rotational speed of the internal combustion engine.

According to the above valve train, when the camshaft supporting arm is angularly displaced, the cam of the camshaft is moved along the slipper surface of the rocker arm toward or away from the fulcrum of the rocker arm, so that the leverage of the rocker arm is changed to thereby increase or decrease the valve lift of the exhaust valve and the intake valve. Simultaneously, the cam gear of the camshaft is rotated in mesh with the idler gear by the displacement of the camshaft supporting arm, so that the phase of the cam rotating together with the camshaft is changed to thereby change the valve timing of the exhaust valve and the intake valve.

However, as the above prior art valve train is adapted to the internal combustion engine of a so-called, "singe overhead camshaft" or (SOHC)-type wherein the intake valve and the exhaust valve are driven through a single camshaft, the valve timing and the valve lift of the intake valve and the exhaust valve cannot be adjusted individually, and it is accordingly difficult to sufficiently utilize the valve trains having this feature.

The present invention has been achieved in consideration of the above circumstances, and it is, accordingly, an object of the present invention to provide a valve driving device and a valve driving method for an internal combustion engine of a double overhead camshaft type in which the valve timing and the valve lift of the intake valve and the exhaust valve can be individually adjusted.

SUMMARY OF THE INVENTION

According to one aspect of the present invention, the above object is achieved by providing in an internal combustion engine including a cylinder head, an idler gear, first and second cam gears commonly meshing said idler gear; first and second camshafts provided over said cylinder head and being driven by said first and second cam gears, respectively; first and second cams provided on said first and second camshafts, respectively; first and second rocker arms contacting said first and second cams and being rocked thereby about fulcrums, respectively; an intake valve contacting said first rocker arm and being driven thereby, and an exhaust valve contacting said second rocker arm and being driven thereby; a valve driving device comprising first and second camshaft supporting arms angularly displaceably mounted at one of their respective end portions on a shaft in coaxial relationship with said idler gear; said first and second camshafts being supported by the respective other end portions of said first and second camshaft supporting arms, and a supporting arm driving mechanism for angularly displacing said first and second camshaft supporting arms according to a change in rotational speed of said internal combustion engine, wherein the phase angle of each said cam and the leverage of each said rocker arm are changed by displacing said first and second camshaft support arms in order to change the valve timing and valve lift of said intake valve and said exhaust valve individually.

In the above construction, it is preferable that said first and second rocker arms for driving said intake valve and said exhaust valve be located symmetrically with respect to the center line of the cylinder of said internal combustion engine, and that said first and second camshaft support arms be displaced symmetrically with respect to said center line of said cylinder.

According to another aspect of the present invention, there is provided in an internal combustion engine including a cylinder head, two camshafts provided over said cylinder head and having at least two cams, at least two rocker arms to be rocked by said at least two cams, and at least one intake valve and exhaust valve to be driven by said at least two rocker arms, a valve driving method wherein, as the rotational speed of said internal combustion engine is increased, the valve timing of said exhaust valve is advanced, the valve timing of said intake valve is retarded, and the valve lifts of said exhaust valve and said intake valve are increased.

With the above construction of the valve driving device according to the present invention, when the two camshaft supporting arms which support the camshafts are moved in association with a change in rotational speed of the internal combustion engine, the cam gears fixed to the camshafts are rotated in mesh with the idler gear. Accordingly, the phase angle of each cam is changed to thereby change the valve timings of the intake valve and the exhaust valve. At the same time, the contact point between each rocker arm and each cam is changed by the displacement of the camshaft supporting arms. Accordingly, the leverage of each rocker arm is changed to thereby change the valve lifts of the intake valve and the exhaust valve.

With the above-described valve driving method according to the present invention, when the rotational speed of the internal combustion engine is increased, the valve timing of the exhaust valve is advanced in comparison with that desired at low engine speeds, thereby expanding a tuned rotational area due to an exhaust pulsation effect, and the valve timing of the intake valve is retarded in comparison with that desired at low engine speeds, thereby expanding a tuned rotational area due to an intake inertia effect. Accordingly, as the time area of valve overlap is in the vicinity of top dead center is reduced in comparison with that at low engine speeds, a reduction in torque at medium engine speeds where an exhaust system fails in an untuned rotational area can be eliminated. Furthermore, as the valve lifts of the intake valve and the exhaust valve are increased, the output of the engine can be increased at high engine speeds.

For a better understanding of the invention, its operating advantages and the specific objectives obtained by its use, reference should be made to the accompanying drawings and description which relate to a preferred embodiment thereof.

DETAILED DESCRIPTION OF THE PREFERRED EMBODIMENTS

Figure 1:
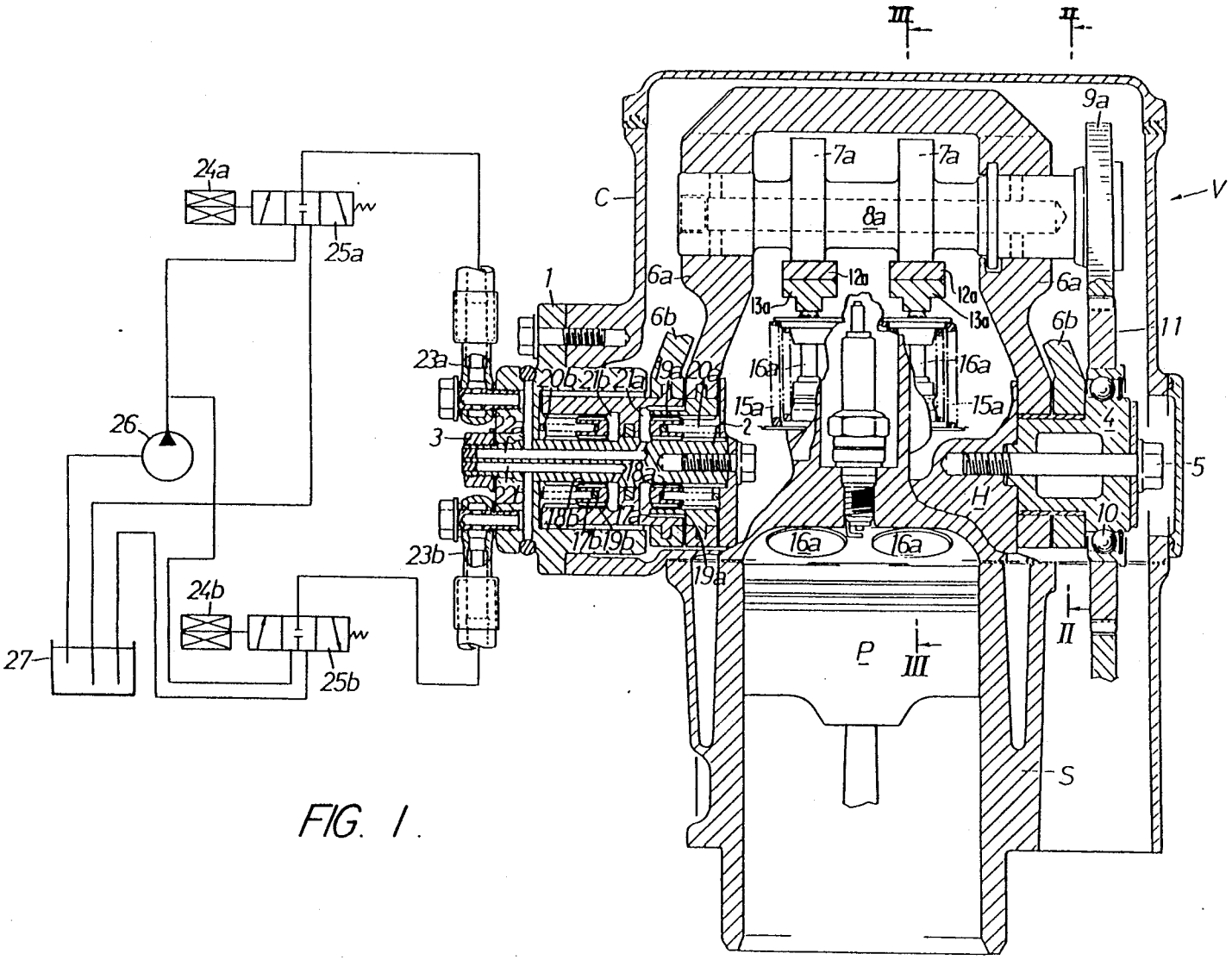
FIG. 1 is a sectional side elevational view of the valve driving device according to a first preferred embodiment of the present invention.
Figure 3:
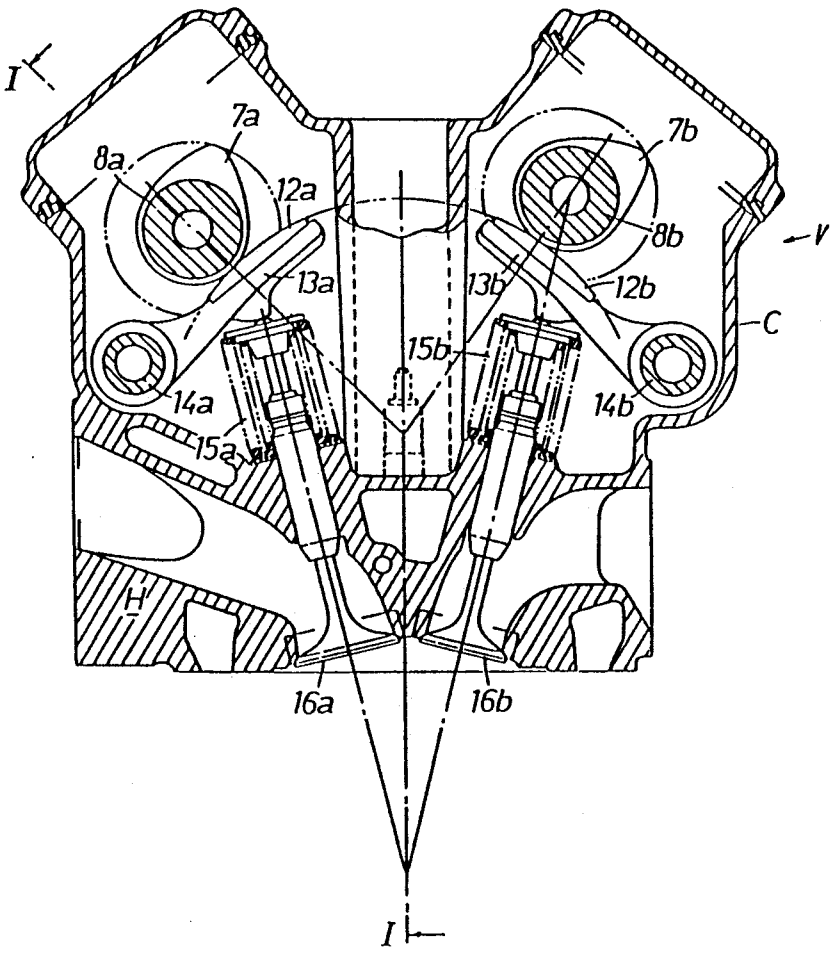
FIG. 3 is a cross-sectional view taken along line III—III of FIG. 1.
Figure 2:
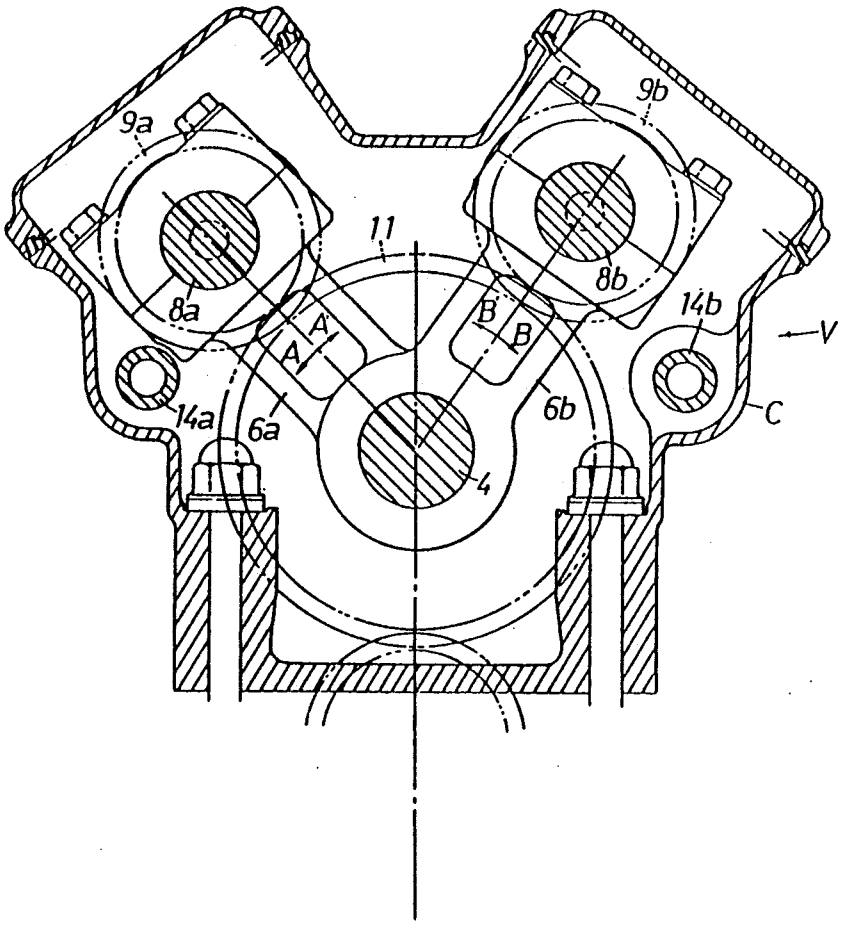
FIG. 2 is a cross-sectional view taken along line II—II of FIG. 1.

In FIGS. 1 to 3 that show a first preferred embodiment of the present invention reference character V generally designates a valve driving device adapted to a 4-cycle internal combustion engine of a double overhead camshaft type. The valve driving device V is mounted in a valve operating chamber defined by a cover C integrally formed with a cylinder head H connected to an upper surface of a cylinder block S in which a piston P is installed.

A spline shaft 2 is fixed by a nut 3 to a cover member 1 at its center which closes an opening formed at one side of the cylinder head H. A boss 4 is fixed by a bolt 5 to the other side of the cylinder head H in such a manner as to be arranged in coaxial relationship with the spline shaft 2. A pair of camshaft supporting arms 6*a* and 6*b* having an inverted U-shape, as viewed in side elevation, are pivotably supported at their lower ends of the spline shaft 2 and to the boss 4. A pair of camshafts 8*a* and 8*b* are rotatably supported to upper portions of the camshaft supporting arms 6*a* and 6*b*, respectively. The camshaft 8*a* is integrally formed with two cams 7*a*, and the camshaft 8*b* is integrally formed with two cams 7*b*. A pair of cam gears 9*a* and 9*b* are fixed to one end portion of the respective camshafts 8*a* and 8*b* and are meshed with a common idler gear 11 rotatably supported through a ball bearing 10 to the boss 4. Two rocker arms 13*a* having slipper surfaces 12*a* which contact the respective cams 7*a* are rockably supported to a rocker shaft 14*a* mounted to the cover C. Similarly, two rocker arms 13*b* having slipper surfaces 12*b* which contact the respective cams 7*b* are rockably supported to a rocker shaft 14*b* mounted to the cover C. The slipper surfaces 12*a* and 12*b* are formed as arcuate surfaces to be configured about a center of the boss 4 mounting the idler gear 11. Two intake valves 16*a* are provided to contact at their upper ends with lower surfaces of the rocker arms 13*a* in such a manner as to be normally biased by two valve springs 15*a* in a valve closing direction. Similarly, two exhaust valves 16*b* are provided to contact at their upper ends with lower surfaces of the rocker arms 13 in such a manner as to be normally biased by two valve springs 15*b* in a valve closing direction.

With this arrangement, when the idler gear 11 is rotated in interlocking relationship with rotation of the crankshaft of the internal combustion engine, the rotation of the idler gear 11 is transmitted through the cam gear 9*a*, the camshaft 8*a*, the two cams 7*a* and the two rocker arms 13*a* to the two intake valves 16*a*. At the same time, the rotation of the idler gear 11 is also transmitted through the cam gear 9*b*, the camshaft 8*a*, the two cams 7*b*, the two rocker arms 13*b* to the two exhaust valves 16*b*.

There is provided around the spline shaft 2 a pair of independent supporting arm driving mechanisms for angularly displacing the camshaft supporting arms 6*a* and 6*b* to adjust valve timing and valve lift of the intake valves 16*a* and the exhaust valves 16*b*. The supporting arm driving mechanism for the intake valves 16*a* is provided with a ring-like piston 17*a* axially slidably mounted between an outer circumferential surface of the spline shaft and an inner circumferential surface of the lower end of the camshaft supporting arm 6*a*. An inner circumferential surface of the piston 17*a* is meshed with the outer circumferential surface of the spline shaft 2 through a straight spline 18*a*, while an outer circumferential surface of the piston 17*a* is meshed with the inner circumferential surface of the lower end of the camshaft supporting arm 6*a* through a helical spline 19*a*. The top surface of the piston 17*a* is biased toward an oil chamber 21*a* by a spring 20*a*. The oil chamber 21*a* is selectively communicated with either a pump 26 or a tank 27 through an oil passage 22*a* formed on the spline shaft 2, a nipple 23*a* and a three-way electromagnetic valve 25*a* to be driven by a solenoid 24*a*.

Accordingly, when the operating position of the three-way electromagnetic valve 25*a* is selected to supply oil pressure from the pump 26 through the nipple 23*a* and the oil passage 22*a* to the oil chamber 21*a*, the piston 17*a* is moved toward the right as viewed in FIG. 1 against the biasing force of the spring 20*a* and is guided by the straight spline 18*a*. At the same time, the camshaft supporting arm 6*a* meshing through the helical spline 19*a* with the outer circumferential surface of the piston 17*a* is moved angularly outwardly in the direction of arrow A shown in FIG. 2. On the other hand, when the operating position of the three-way electromagnetic valve 25a is reversely selected to communicate the oil chamber 21a to the tank 27, the piston 27a is moved toward the left as viewed in FIG. 1 by the biasing force of the spring 20a. As a result, the camshaft supporting arm 6a is moved angularly inwardly in the direction of arrow A' shown in FIG. 2.

Similarly, the support arm driving mechanism for the exhaust valves 16b is constructed of a piston 17b, a straight spline 18b, a helical spline 19b, a spring 20b and an oil chamber 21b. When oil pressure is supplied from the pump 26 to the oil chamber 21b through a three-way electromagnetic valve 25b to be driven by a solenoid 24b, a nipple 23b and an oil passage 22b, the camshaft supporting arm 6b is pivoted outwardly in the direction of arrow B shown in FIG. 2, while when the oil pressure is discharged to the tank 27, the camshaft supporting arm 6b is pivoted inwardly in the direction of B' shown in FIG. 2.

In FIGS. 2 and 3, the camshaft supporting arm 6a is shown in a high engine speed position, and the camshaft supporting arm 6b is shown is a low engine speed position.

The operation of the first preferred embodiment of the present invention is as follows. When the internal combustion engine is operated, the crankshaft is rotated to rotate the idler gear 11. The rotation of the idler gear 11 is transmitted through the cam gears 9a and 9b to the camshafts 8a and 8b, respectively, thereby rotating the camshafts 8a and 8b at a rotational velocity of one-half of the rotational speed of the crankshaft. Accordingly, the rocker arms 13a and 13b contacting the cams 7a and 7b integral with the camshafts 8a and 8b are rocked about the rocker shafts 14a and 14b by the rotation of the cams 7a and 7b, respectively. As a result, the intake valves 16a and the exhaust valves 16b are depressed by the lower surfaces of the rocker arms 13a and 13b, respectively, and are opened once every two revolutions of the crankshaft.

When the internal combustion engine is operated at low speeds, both the pistons 17a and 17b of the respective supporting arm driving mechanisms remain retracted by the biasing forces of the springs 20a and 20b, respectively. Accordingly, both the camshaft supporting arms 6a and 6b are maintained in their inwardly displaced positions (the positions indicated by the directions of arrows A' and B' in FIG. 2). That is, both the camshaft support arms 6a and 6b remain close to each other.

Figure 4:
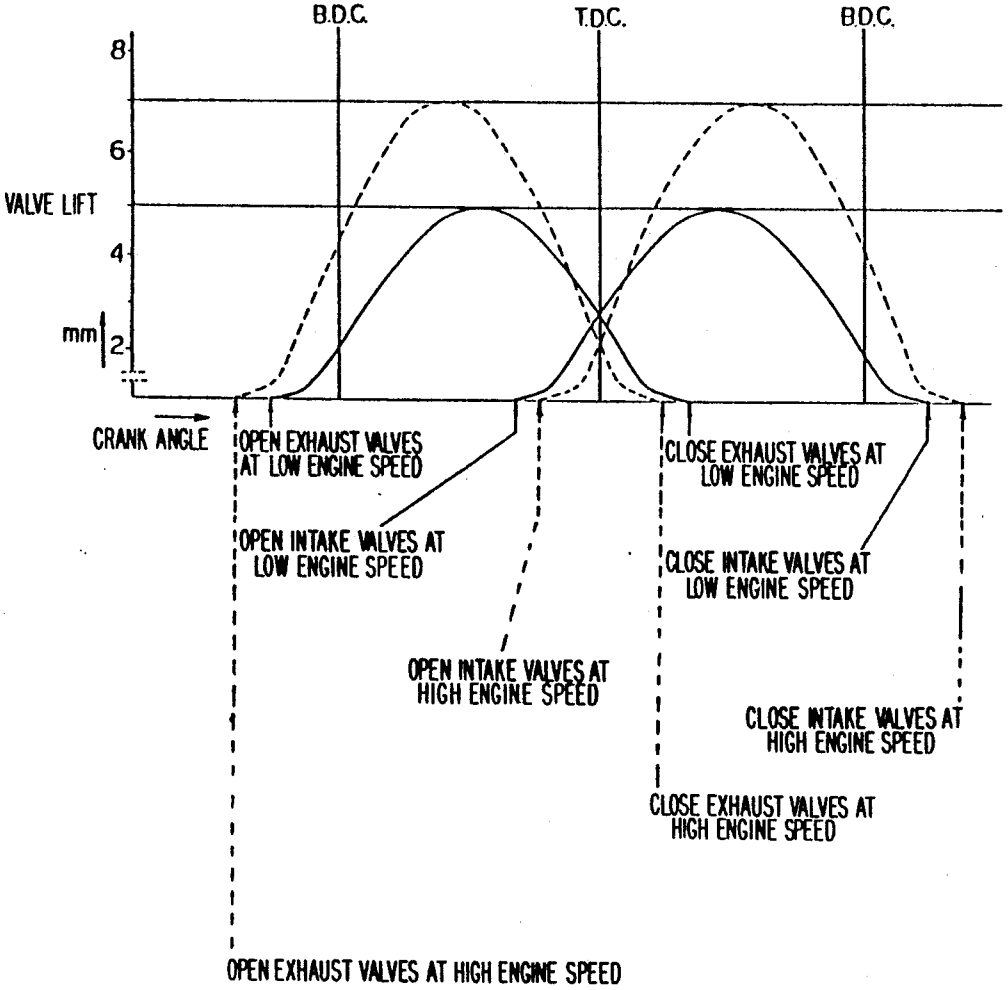
FIG. 4 is a graph showing the characteristics of valve timing and valve lift according to the first preferred embodiment of the invention.

Referring to FIG. 4, the solid line shows the valve timing and valve lift at low engine speeds. As is apparent from FIG. 4, the valve timing of the exhaust valves 16b is set in such a manner that the exhaust valves 16b are opened at a position just before B.D.C. (bottom dead center), and are closed at a position just after T.D.C. (top dead center) On the other hand, the valve timing of the intake valves 16a is set in such a manner that the intake valves 16a are opened at a position just before T.D.C., and are closed at a position just after B.D.C. A characteristic curve of the valve timings of the exhaust valves 16b and the intake valves 16a is symmetric with respect to T.D.C. The time area of valve overlap wherein both the intake valves 16a and the exhaust valves 16b are opened in the vicinity of T.D.C. is set to be relatively large. Further, the valve lifts of the intake valves 16a and the exhaust valves 16b are both set to a relatively small value of about 5 mm.

When the rotational speed of the internal combustion engine is increased from the above condition, the solenoids 24a and 24b are energized to open the three-way electromagnetic valves 25a and 25b and thereby supply oil pressure from the pump 26 to the oil chambers 21a and 21b of both the supporting arm driving mechanisms. As a result, both the camshaft supporting arms 6a and 6b are controllably angularly displaced outwardly to stop at a suitable position corresponding to the increased engine speed, thereby varying the valve timing and the valve lift correspondingly.

Figure 5:
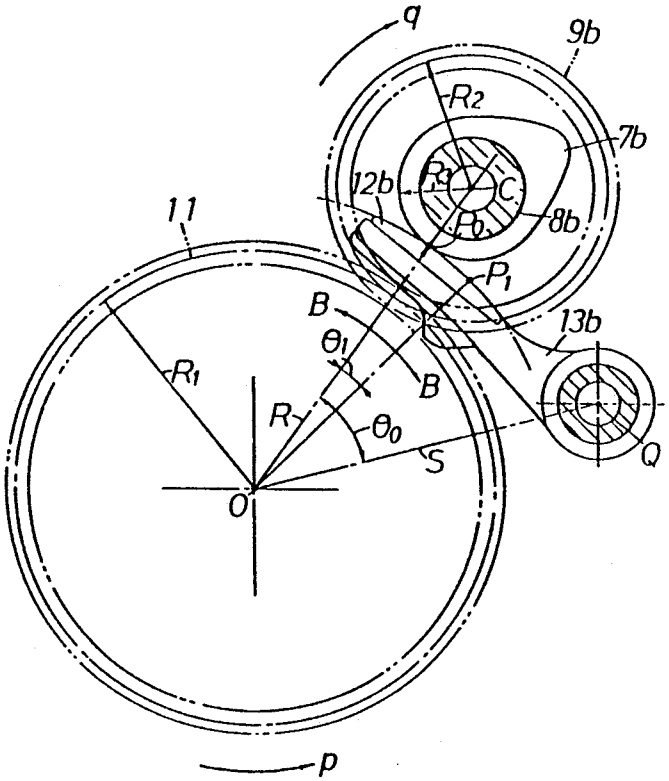
FIG. 5 is a largely schematic illustration explaining the principle of variation in valve timing and valve lift according to the first preferred embodiment of the invention.

The principle of the variation in the valve timing and the valve lift to be caused by the angular displacement of the camshaft supporting arms 6a and 6b will now be described in connection with the exhaust valves 16b by way of example. Referring to FIG. 5, the idler gear 11 is set to be rotated in a direction of arrow p, and the cam gear 9b meshing with idler gear 11 is set to be rotated in the direction of arrow q. The cam 7b of the camshaft 8b, rotating together with the cam gear 9b, is in contact with the slipper surface 12b of the rocker arm 13b. Reference character 0 designates the center of the idler gear 11; $R_1$ the radius of the pitch circle of the idler gear 11; C the center of the cam gear 9b; $R_2$ the radius of the pitch circle of the cam gear 9b; $R_3$ the radius of the base circle of the camshaft 8b; R the radius of curvature of the slipper surface 12b of the rocker arm 13b ($R=R_1+R_2-R_3$); Q the fulcrum center of the rocker arm 13b; and S the distance between the center 0 of the idler gear 11 and the fulcrum center Q of the rocker arm 13b.

Under the low engine speed condition shown in FIG. 5, the base circle of the cam 7b is in contact with the slipper surface 12b of the rocker arm 13b at a point $P_0$. When the rotational speed of the internal combustion engine is increased from this condition, the camshaft supporting arm 6b is moved angularly outwardly (in the direction of arrow B in FIG. 5). As a result, the contact $P_0$ is shifted to a point $P_1$ where the base circle of the cam 7b contacts the slipper surface 12b of the rocker arm 13b. Since the rotational directions of the idler gear 11 and the cam gear 9b are previously set to the directions of arrows p and q, respectively, the cam gear 9b is rolled on the outer circumference of the idler gear 11 to rotate in the direction of arrow q. Accordingly, the phase of the cam gear 9b is advanced. Letting $\phi$ and $\theta$ denote the change in phase of the cam gear 9b and the rocking angle of the camshaft supporting arm 6b, respectively, the following equation holds:

$$\phi R_2=\theta_1 R_1$$

Accordingly, the change $\phi$ in phase is given as follows:

$$\phi=(R_1/R_2)\theta_1$$

Thus, the phase of the cam gear 9b, that is, the cam 7b is advance by $\phi$, and the valve timing of each exhaust valve 16b is, therefore, advanced.

Furthermore, as the contact point between the base circle of the cam 7b and the slipper surface 12b of the rocker arm 13b is shifted from the point $P_0$ to the point $P_1$ by the outward angular movement of the camshaft supporting arm 6b (in the direction of arrow B), the leverage $QP_0$ of the rocker arm 13b is reduced to $QP_1$. As a result, the rocking angle of the rocker arm 13b is increased to thereby increase the valve lift of each exhaust valve 16b. That is, ratio $\eta$ of the leverage is given as follows:

$$\eta = QP_1/QP_0$$

Applying a cosign theorem to the triangle $Q0P_0$ and the triangle $Q0P_1$, the above equation is expressed as follows:

$$\eta = \sqrt{\frac{S^2 + R^2 - 2SR\cos(\theta_0 - \theta_1)}{S^2 + R^2 - 2SR\cos\theta_0}}$$

It can thus be understood that the leverage ratio $\eta$ decreases with an increase in $\theta_1$ (i.e., an increase in the displacement angle of the camshaft supporting arm 6b).

Simultaneously with the change in valve timing and valve lift of the exhaust valves 16b by the outward movement of the camshaft supporting arm 6b, the camshaft supporting arm 6a is also driven to be moved outwardly, with the result that the valve timing of the intake valves 16a is retarded in a manner reversed to the case of the exhaust valves 16b, and the valve lift of the intake valves 16a is increased in the same manner as the case of the exhaust valves 16b.

As shown by the dash line in FIG. 4, the valve timing of the exhaust valves 16b at high speeds of the internal combustion engine is advanced in comparison with that at low engine speeds, so that a tuned rotational area due to an exhaust pulsation effect can be expanded. Simultaneously, the valve timing of the intake valves 16a at high engine speeds of the internal combustion engine is retarded in comparison with that at low engine speeds, so that a tuned rotational area due to an intake inertia effect can be expanded. Furthermore, the time area of the valve overlap in the vicinity of T.D.C. at high engine speeds is reduced in comparison with that at low engine speeds, thereby eliminating a reduction in torque at medium engine speeds where the exhaust system fails in an untuned rotational area. Further, the valve lifts of the intake valves 16a and the exhaust valves 16b are both increased to about 7 mm at high engine speeds, thereby increasing an output at high engine speeds.

Figure 6:
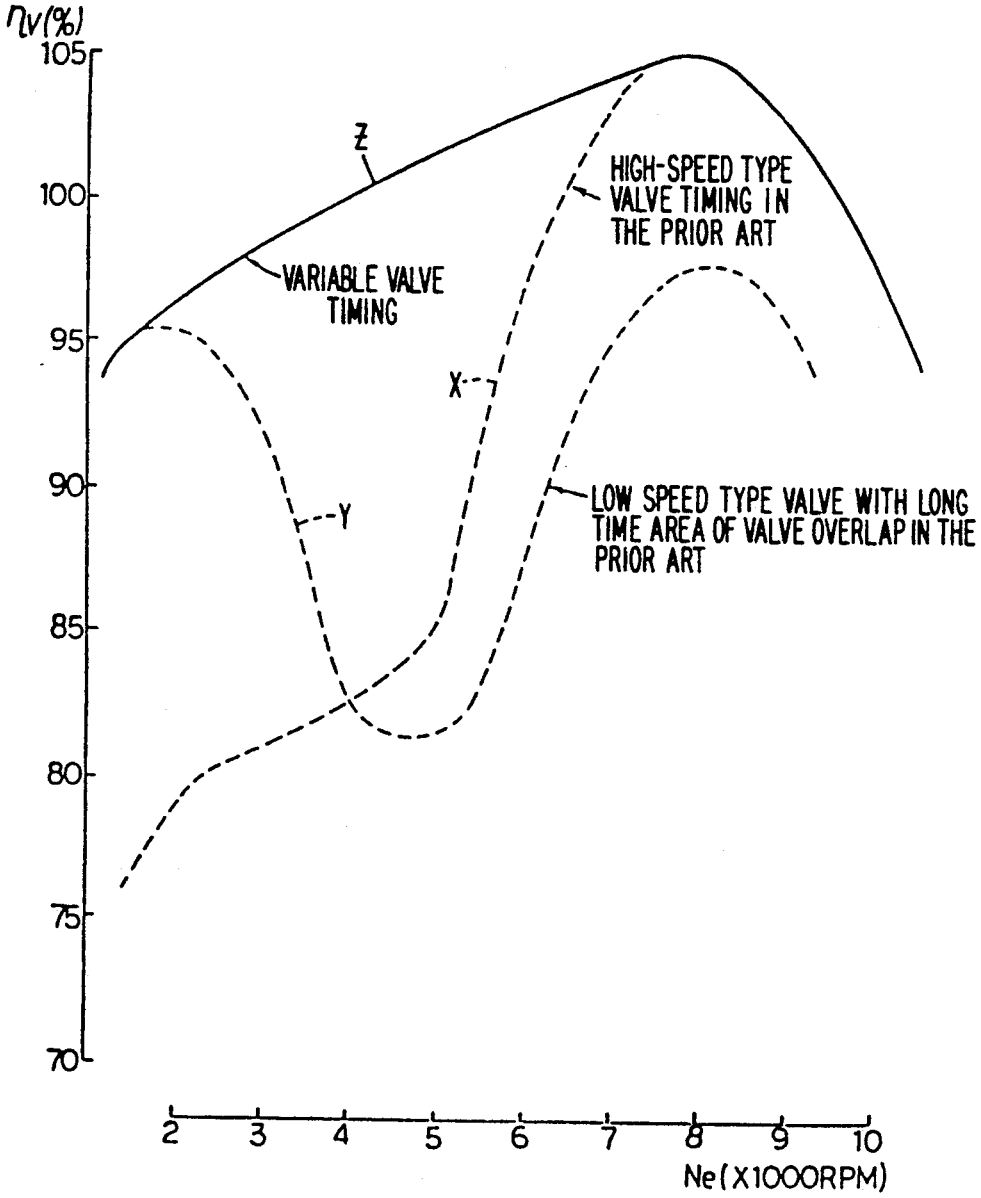
FIG. 6 is a graph showing the volumetric efficiency of intake air according to the first preferred embodiment of the invention.

As shown in FIG. 6, in an internal combustion engine adopting a high-speed type valve timing in the prior art, there is the problem that the volumetric efficiency of $\eta V$ of the intake air in the low-speed region is reduced, as shown by the dashed line X. Also, in an internal combustion engine adopting a low-speed type valve timing with a time area of valve overlap set to be large in the prior art, there is the problem that the volumetric efficiency $\eta V$ in the medium-speed region is reduced, as shown by a dashed line Y. On the other hand, however, according to the present invention, the reduction in the volumetric efficiency $\eta V$ in the medium-speed region is compensated, as shown by the solid line Z, thus obtaining a generally flat torque characteristic.

Figure 7:
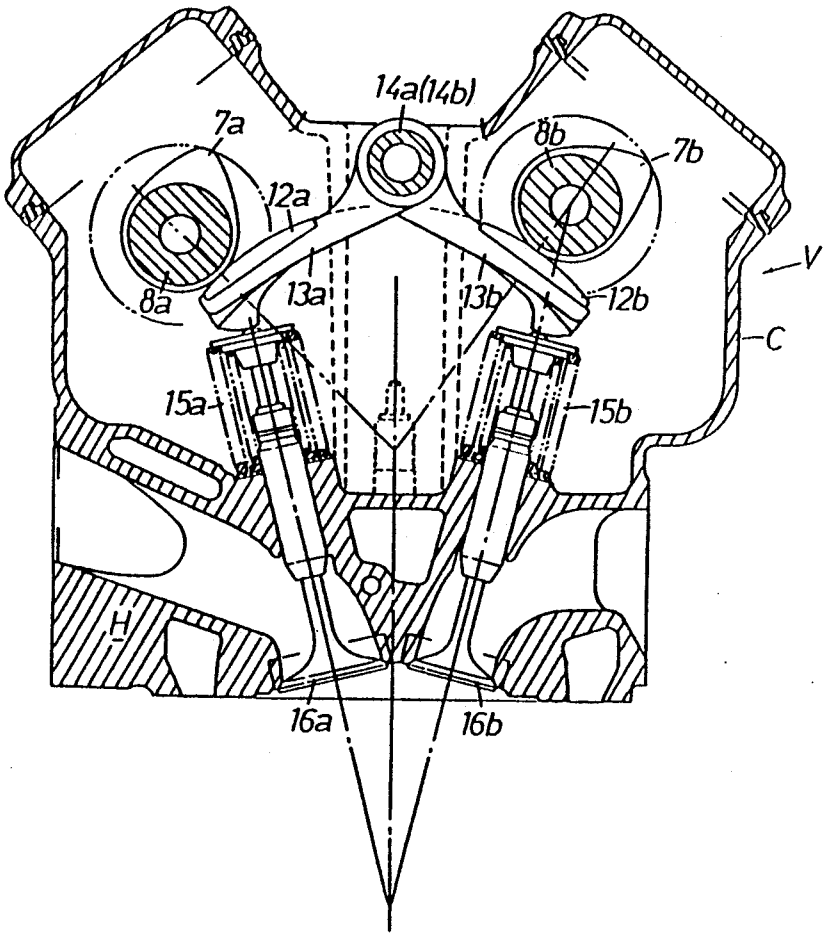
FIG. 7 is a view similar to FIG. 3, showing a second preferred embodiment of the present invention.

FIG. 7 shows a second preferred embodiment of the present invention, which is characterized in that the fulcrums 14a and 14b of the rocker arms 13a and 13b are coaxially located at an intermediate position between the camshafts 8a and 8b. Further, the moving direction of the camshafts 8a and 8b is set to be reversed from that in the first preferred embodiment. That is, in the low-speed region of the engine, the camshafts 8a and 8b are driven outwardly so as to shift the contact points between the cams 7a and 7b and the rocker arms 13a and 13b away from the fulcrums 14a and 14b, respectively. Conversely, in the highspeed region of the engine, the camshafts 8a and 8b are driven inwardly so as to shift the contact points between the cams 7a and 7b and the rocker arms 13a and 13b toward the fulcrums 14a and 14b, respectively. With this arrangement, the characteristics of the valve timing and the valve lift similar to those shown in FIG. 4 can be obtained to thereby realize a high output in a wide range of speeds.

Figure 8:
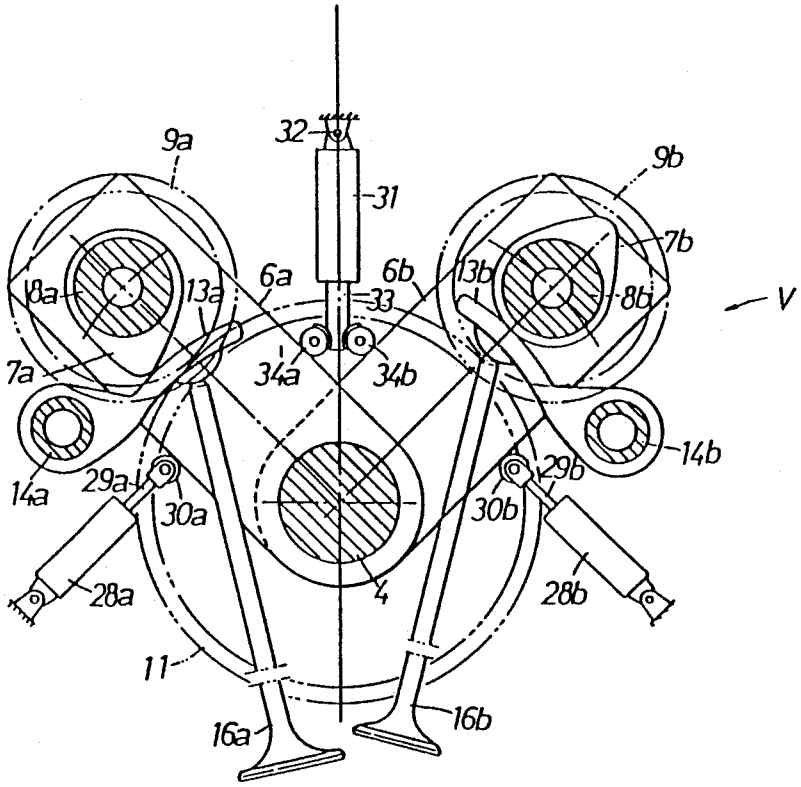
FIG. 8 is a view similar to FIG. 2, showing a third preferred embodiment of the present invention.

FIG. 8 shows a third preferred embodiment of the present invention, which is characterized principally by the structure of the supporting arm driving mechanism. The supporting arm driving mechanism in the third preferred embodiment is provided with a pair of hydraulic cylinders 28a and 28b. A pair of rollers 30a and 30b are provided at free ends of piston rods 29a and 29b extending from the hydraulic cylinders 28a and 28b, respectively. The rollers 30a and 30b are in contact with the lower surfaces of the camshaft supporting arms 6a and 6b, respectively. On the other hand, another hydraulic cylinder 31 is supported at its one end to a pivotal shaft 32 over the camshaft supporting arms 6a and 6b. A pair of rollers 34a and 34b are provided at the free end of a piston rod 33 extending from the hydraulic cylinder 31. The rollers 34a and 34b are in contact with the upper surfaces of the camshaft supporting arms 6a and 6b, respectively. Accordingly, the camshaft supporting arms 6a and 6b can be independently angularly displaced in an arbitrary direction by selectively connecting the three hydraulic cylinders 28a, 28b and 31 to the pump and the tank. Therefore, according to this preferred embodiment, the valve timing and the valve lift of the intake valves 16a and the exhaust valves 16b can be adjusted more precisely to further improve the performance.

Furthermore, while the exhaust noise that accounts for a large proportion of the operating noise of an engine is caused by a vibration source due to the pressure of a positive pressure wave in an exhaust pipe, which wave is generated by blow-down of an exhaust gas just after opening of the exhaust valves, the pressure of the positive pressure wave can be reduced by reducing the valve opening speed of the exhaust valves to effect slow blow-down. Accordingly, in this preferred embodiment, the exhaust noise can be reduced by reducing the valve lift of the exhaust valves in the normal operating region of the engine.

Figures 9A, 9B, 9C, 9D, 9E, 9F:
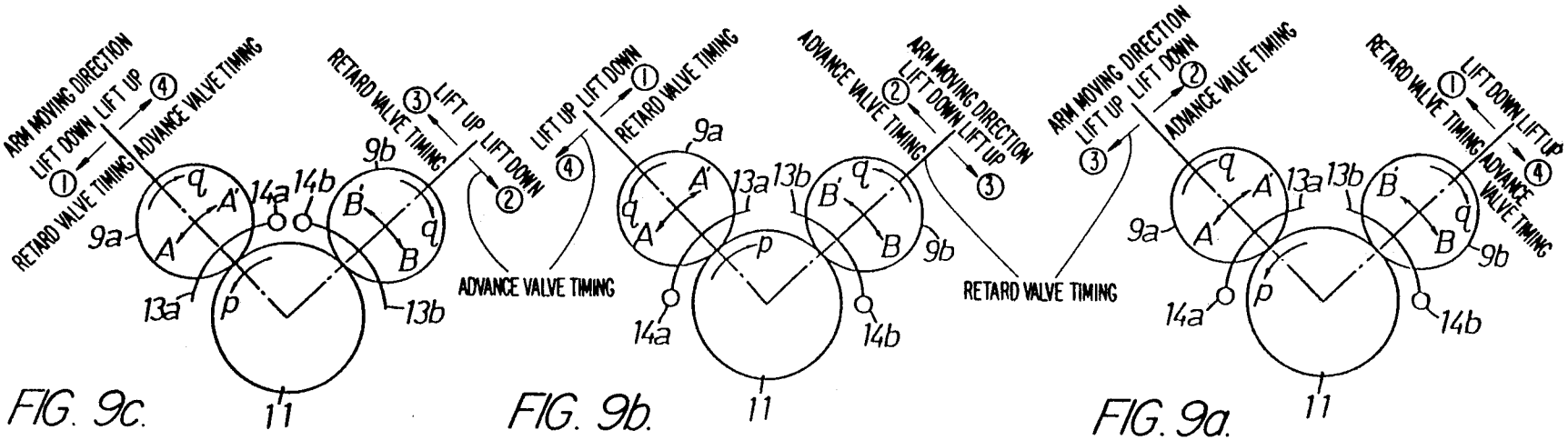
FIGS. 9A to 9F are schematic illustrations of variations of the layout of the rocker arms.
Figure 10A:
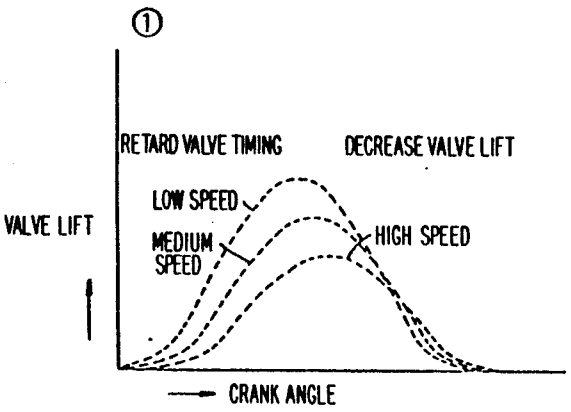
FIGS. 10(1)-10(4) are graphs showing variations of the valve operating characteristics.
Figure 10B:
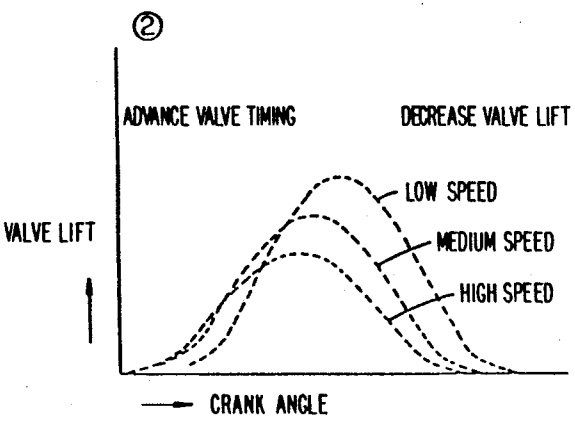
Figure 10C:
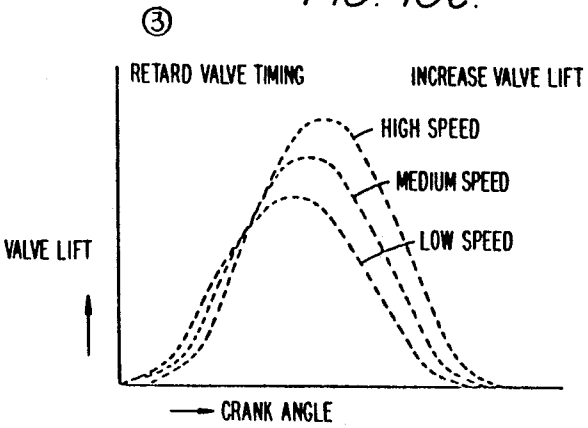
Figure 10D:
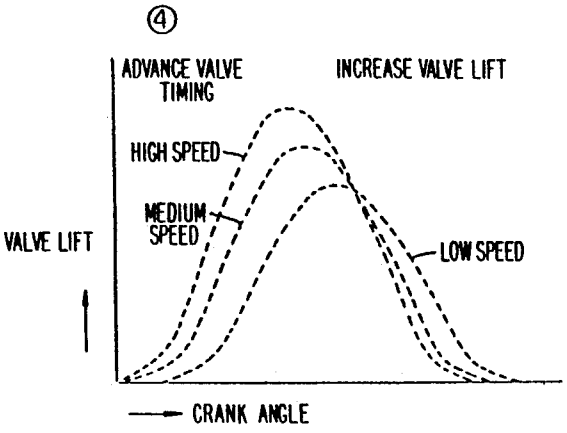

Having thus described the specific embodiments of the present invention, it should be appreciated that the present invention is not limited to the above-described preferred embodiments, but that various modifications in design may be made without departing from the scope of the present invention as defined in the claims. For example, various diverse valve characteristics can be obtained by selecting the direction of the rocker arms 13a and 13b and the position of the fulcrums 14a and 14b. Referring to FIG. 9A which corresponds to the first preferred embodiment as mentioned previously, the rocker arms 13a and 13b directed inwardly are rockably supported by the fulcrums 14a and 14b located outwardly of the camshaft supporting arms 6a and 6b, respectively. According to this layout, a valve characteristic corresponding to graph (2) or (3) in FIG. 10 can be obtained by displacing the camshaft supporting arm 6a in the direction of arrow A or A' in FIG. 9A. In contrast, a valve characteristic corresponding to graph (1) or (4) in FIG. 10 can be obtained by displacing the camshaft supporting arm 6b in the direction of arrow B or B' in FIG. 9A. The above valve characteristics can be changed as shown in FIG. 9B by reversing the rotational direction of the idler gear 11 and the rotational direction of the cam gears 9*a* and 9*b*.

Referring to FIG. 9D, which corresponds to the second preferred embodiment as mentioned previously, the rocker arms 13*a* and 13*b* directed outside are rockably supported by the fulcrums 14*a* and 14*b* located inwardly of the camshaft supporting arms 6*a* and 6*b*, respectively. This layout can also provide the valve characteristics corresponding to graphs (1) to (4) shown in FIG. 10. The valve characteristics of FIG. 9D can be changed, as shown in FIG. 9C, by reversing the rotational direction of the idler gear 11 and the rotational direction of the cam gears 9*a* and 9*b*.

The layout of the rocker arms 13*a* and 13*b* can be further varied as shown in FIGS. 9E and 9F. By suitably combining these variations, any one of the four kinds of valve characteristics corresponding to the graphs (1) to (4) in FIG. 10 can be obtained as required.

Further, although the supporting arm driving mechanisms for displacing the camshaft supporting arms 6*a* and 6*b* are hydraulically driven in the above preferred embodiments, they may be driven electrically. For example, eccentric cams contacting the camshaft supporting arms 6*a* and 6*b* may be provided, and they may be moved by step motors through predetermined angular amounts.

Further, although the slipper surfaces 12*a* and 12*b* of the rocker arms 13*a* and 13*b* are formed as arcuate surfaces concentric with the idler gear 11 in the above preferred embodiments, the center of the curvature of the slipper surfaces 12*a* and 12*b* may be displaced from the center of the idler gear 11, thereby changing the valve clearance at low engine speeds and high engine speeds. For example, when the slipper surfaces 12*a* and 12*b* of the rocker arms 13*a* and 13*b* are made slightly high on the side distant from the fulcrums 14*a* and 14*b*, the valve clearance at low engine speeds can be reduced to thereby reduce noise.

Additionally, the number of the respective intake valves 16*a* and exhaust valves 16*b* need not be limited to two. For example, a single intake valve and a single exhaust valve may be provided. Alternatively, there may be only a single intake valve or exhaust valve and the number of the other may be two. Further, the power transmission from the crankshaft to the idler gear 11 may be effected by either a gear or a chain.

According to the valve driving device of the present invention, therefore, the adjustment of valve timing by a change in phase angle of each cam and the adjustment of valve lift by a change in leverage of each rocker arm can be effected for both the intake valve and the exhaust valve individually. Accordingly, more effective valve characteristics can be obtained over a wide range from a low engine speed region to a high engine speed region.

Where the rocker arms for driving the intake valve and the exhaust valve are located symmetrically with respect to the center line of the cylinder, and the two camshaft supporting arms are displaced symmetrically with respect to the center line of the cylinder, the valve timings and the valve lifts of both valves can be adjusted in association with each other, thereby obtaining more favorable operating characteristics.

According to the valve driving method of the present invention, when the rotational speed of the internal combustion engine is increased, the valve timing of the exhaust valve is advanced in comparison with that at low engine speeds, thereby expanding a tuned rotational area due to an exhaust pulsation effect, and the valve timing of the intake valve is retarded in comparison with that at low engine speeds, thereby expanding a tuned rotational area due to an intake inertia effect. Accordingly, as the time area of valve overlap in the vicinity of top dead center is reduced in comparison with that at low engine speeds, a reduction in torque at medium engine speeds where an exhaust system falls in an untuned rotational area can be eliminated. Furthermore, as the valve lift of the intake valve and the exhaust valve are increased, engine output can be increased at high engine speeds.

It should be further understood that further changes and modifications can be made in the described arrangement without departing from the scope of the appended claims.

I claim:

1. An internal combustion engine having a cylinder, intake and exhaust valves operative in said cylinder, pivotably mounted rocker arms operatively engaging each of said valves, respectively, a cam mounted on a first camshaft and engaging a said rocker arm for operating said intake valve and a cam mounted on a second camshaft and engaging a said rocker arm for operating said exhaust valve, and means for controllably varying the phase angle of said cams and the extent of valve lift imparted thereby, comprising:

first camshaft support means journalling one of said camshafts for rotation and being displaceably mounted with respect to the rocker arm operating said intake valve;

second camshaft support means journalling the other of said camshafts for rotation and being displaceably mounted with respect to the rocker arm operating said exhaust valve;

means for rotatably driving said camshafts; and driving mechanism operatively connecting each of said first and second camshaft support means for displacing said support means with respect to their respective associated rocker arm to vary the phase angles of said cams and extent of valve lift imparted to said valves thereby in response to changes in engine operating conditions.

2. An internal combustion engine according to claim 1 in which said driving mechanism includes means for independently displacing each of said camshaft support means.

3. An internal combustion engine according to claim 2 in which said rocker arm for operating said intake valve and said rocker arm for operating said exhaust valve are each disposed symmetrically with respect to said cylinder, and in which said camshaft support means move symmetrically with respect to said cylinder.

4. An internal combustion engine according to claim 1 in which said camshaft driving means comprises an idler gear driven by said engine, said camshafts each having cam gears meshing with said idler gear, said driving mechanism being operative to selectively displace each of said camshaft support means for varying the point of contact of said cam gear with said idler gear.

5. An internal combustion engine according to claim 4 in which said camshaft support means each comprise a camshaft support arm having a pivot axis at one end coaxial with the rotational axis of said idler gear and having means at the other end for journalling said camshaft for rotation.

6. An internal combustion engine according to claim 5 in which said rocker arms have slipper surfaces for engaging said cams, said slipper surfaces being arcuately formed and concentric with the axis of said idler gear.

7. An internal combustion engine according to claim 6 in which said rocker arms are pivotally attached to mutually spaced rocker shafts disposed outwardly of said camshafts.

8. An internal combustion engine according to claim 6 in which said rocker arms are pivotally attached to a single rocker shaft disposed intermediate said camshafts.

9. An internal combustion engine according to claim 5 in which said driving mechanism for each said support arm includes a fluid operated piston operatively connected to said support arm for displacing it angularly in response to axial movement of said piston, and a hydraulic system for controlling fluid flow to said piston in response to engine operating conditions.

10. An internal combustion engine according to claim 9 in which said piston has helically formed splines on a surface thereof engageable with cooperating splines on said camshaft support arm for moving said support arm angularly in response to axial movement of said piston.

11. An internal combustion engine according to claim 9 in which said piston is operative in a pivotally mounted cylinder and has a connecting rod engageable with said camshaft support arm.

12. An internal combustion engine according to claim 11 in which said connecting rod operates in a first cylinder and engages one side of said camshaft support arm and said driving mechanism includes a second cylinder having a connecting rod engageable with the other side of said camshaft support arm, and a hydraulic system in which fluid is controllably supplied to both of said cylinders for controlling the angular movement of said camshaft support arm.

13. In an internal combustion engine having a cylinder, an intake valve and an exhaust valve operative in said cylinder, independently mounted camshafts bearing cams for operating each of said intake and exhaust valves respectively, a method for operating said valves comprising the steps of:

sensing the rotational speed of said engine; and, in response to an increase therein, advancing the closing timing of said exhaust valve, retarding the opening timing of said intake valve; and increasing the lift of both of said intake and exhaust valves.

14. In the method of claim 13 the further step of retarding the timing of said intake valve independent of advancing the timing of said exhaust valve.

* * * * *